United States Patent [19]

Willey

[11] Patent Number: 4,635,306

[45] Date of Patent: Jan. 13, 1987

[54] MULTI-POSITION THERAPY CUSHIONS

[75] Inventor: Donald E. Willey, Santa Barbara, Calif.

[73] Assignees: Rose L. Arnold; Ned M. Rafter, both of Santa Barbara, Calif. ; part interest to each

[21] Appl. No.: 693,533

[22] Filed: Jan. 22, 1985

[51] Int. Cl.[4] ..... A47C 20/00; A47C 27/00

[52] U.S. Cl. ..... 5/431; 5/432; 5/465

[58] Field of Search ..... 5/431, 432, 433, 436, 5/437, 446, 465

[56] References Cited

U.S. PATENT DOCUMENTS

| | | | |
|---|---|---|---|
| 885,243 | 4/1908 | Haas | 5/431 |
| 3,555,582 | 1/1971 | Radford | 5/436 |
| 3,736,023 | 5/1973 | Lyons | 5/465 |
| 3,938,205 | 2/1976 | Spann | 5/431 |
| 4,171,549 | 10/1979 | Morrell et al. | 5/465 |
| 4,473,913 | 10/1984 | Ylvisaker | 5/436 |

FOREIGN PATENT DOCUMENTS

| | | | |
|---|---|---|---|
| 1065909 | 4/1967 | United Kingdom | 5/446 |

*Primary Examiner*—Gary L. Smith
*Assistant Examiner*—Michael F. Trettel
*Attorney, Agent, or Firm*—Kenneth J. Hovet

[57] ABSTRACT

Therapy cushions are provided having angular body supporting surfaces. The cushions can be juxtapositioned to orient patients in various positions for achieving effective bronchial drainage. First and second cushions have two adjoining 90° abutment surfaces with corresponding abutment corners. Each of the surfaces terminate at flattened end areas from which extend body-contacting sloping portions. The sloping portion of one cushion is indented and includes a predetermined inclined surface. A wedge cushion may be used to tilt the patient.

8 Claims, 8 Drawing Figures

MULTI-POSITION THERAPY CUSHIONS

BACKGROUND OF THE INVENTION

1. Field of the Invention

The present invention relates to cushions utilized for therapeutic purposes and, more particularly, to cushions arrangable in different positions for orienting a person thereon for effective bronchial drainage.

2. Description of the Prior Art

Bronchial drainage is a form of chest physical therapy prescribed for the treatment and prevention of many types of respiratory problems. It involves the removal of accumulated secretions from mucous glands lining the airways of the bronco-pulmonary tract. Through the use of gravity and physical maneuvers (chest clapping or vibration by a therapist), accumulated secretions can be dislodged from the airways.

Careful orientation of the patient facilitates the gravity flow of secretions from the small airways of each lobe to the larger airways where the secretions can be coughed out. The lung segment to be drained is placed uppermost and the airway leading to that segment is placed in as near a vertical position as possible.

To orient the patient for effecting drainage of any particular lung segment, a chair, tiltable bed or padded board with pillows is most commonly used. These, of course, are imprecise and oftentimes ineffective.

Split padded boards which can be raised or lowered by mechanical gears or hydraulic cylinders are also sometimes used by respiratory therapists. Such boards, however, are expensive, heavy and cumbersome to use. Further, they are difficult to store and have inherent limitations on positioning a patient's body. Most often, such devices are only available in medical offices, clinics and hospitals.

SUMMARY OF THE INVENTION

The present invention provides two basic cushions uniquely designed to interrelate and form a variety of body supporting configurations for effective respiratory therapy. Such is accomplished without cumbersome mechanical means and at very low cost. Because of the low cost and simple operation, in-home therapy is possible.

Each cushion has a pair of corresponding abutment surfaces extending about 90° from respective abutment corners. Corresponding surfaces from each cushion can either abut against each other or face down and rest upon an underlying surface such as a floor or table.

At the ends of the abutment surfaces are 90° flattened areas from which extend sloping body-contacting portions. On the first cushion, the sloping portion includes an inclined surface carefully angled to provide the desired body configuration. When the cushions are joined in either of two primary positions, the respective flattened areas will be coextensive and form an additional body-supporting surface at the apex of the juxtaposed cushions.

DESCRIPTION OF THE PREFERRED EMBODIMENTS

Figure 1:
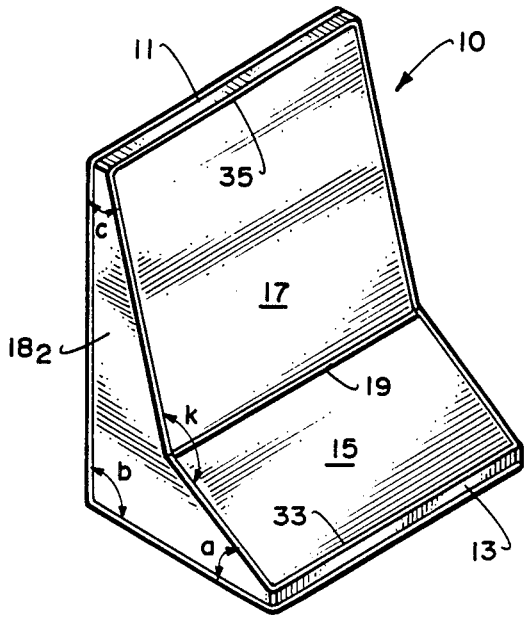
FIG. 1 is a front perspective view of the first cushion of the invention in its uppermost position.

With reference now to the drawings, FIG. 1 shows the first cushion (10) which is a polyhedron. It has a first abutment corner (12) which defines the lateral axis $z_1$ thereof. Extending from the corner is first surface (14). Although not essential, the first surface is planar and a parallelogram in shape. It terminates longitudinally on the $x_1$ axis at first juncture (11). The first juncture is flat and rectangular in shape and extends at an angle of about 90° from the first surface.

Extending from the corner (12) about 90° (angle b) from said first surface is second surface (16). It also is planar and a parallelogram in shape. It terminates along lateral axis $y_1$ at first end area (13). The first end area is a flat rectangular surface similar to the first juncture. It extends about 90° from the second surface.

Extending from adjacent corner (33) of the first end area is inclined surface (15). The surface is flat and rectangular in shape and inclines at an angle of about 30°, as shown by angle a, with second surface (16).

Extending from adjacent corner (35) of first juncture (11) is sloping portion (17). Said portion forms almost a 15° angle, as shown by angle c, with first surface (14). It is flat and rectangular in shape and has an area about twice that of the inclined portion. The sloping portion and inclined surface meet at first junction (19) forming an angle k of about 135°.

The first cushion has bilaterally symetrical sidewalls ($18_1$, $18_2$) which are parallel to each other. They are sixsided polygons with three 90° angles.

Figure 2:
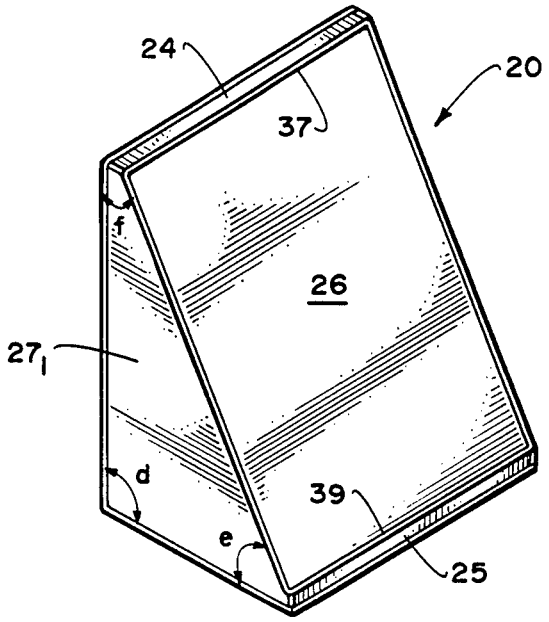
FIG. 2 is a front perspective view of the second cushion of the invention in its uppermost position.

The second cushion (20) shown in FIG. 2 is a polyhedron and includes non-body contacting surfaces that are about identical to corresponding surfaces on the first cushion. Fourth surface (23) and first surface (14) are matching corresponding surfaces as are second surface (16) and third surface (21). The third and fourth surfaces diverge about 90° (angle d) from a second abutment corner (22). Said corner also defines the lateral axis $z_2$ of the second cushion.

The third surface (21) terminates along normal axis $y_2$ at second end area (25). The area is flat and rectangular in shape and extends about 90° from the third surface.

Likwise, the fourth surface (23) terminates along longitudinal axis $x_2$ at a flat rectangular shaped second juncture (24). The juncture extends about 90° from the fourth surface.

Spanning adjacent corner (37) of second juncture (24) and adjacent corner (39) of second end area (25) is second sloping portion (26). Said portion forms a body-contacting area that is about 60° (angle e) from the third surface and about 30° (angle f) from the fourth surface. Such angles have been predetermined to provide the optimum in patient positioning, in combination with the first cushion, for clearing the various lung segments.

Opposing sidewalls ($27_1$, $27_2$) of the second cushion are bilaterally symetrical planar areas equidistance from each other. They are five-sided polygons having three 90° angles.

Figure 3:
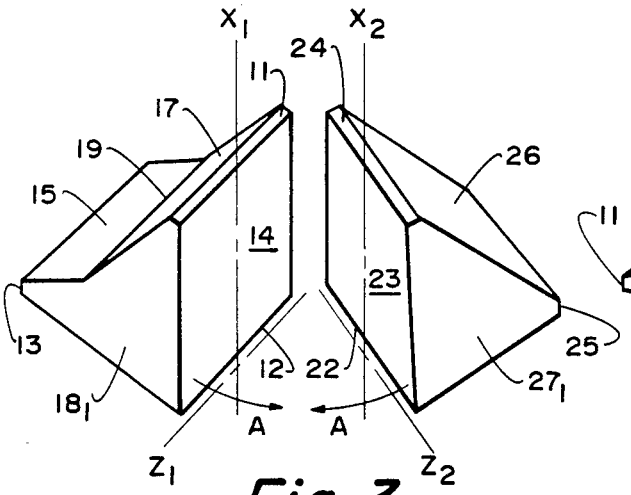
FIG. 3 is a back perspective view of the first and second cushions in their uppermost position being moved together into a second configuration.
Figure 5:
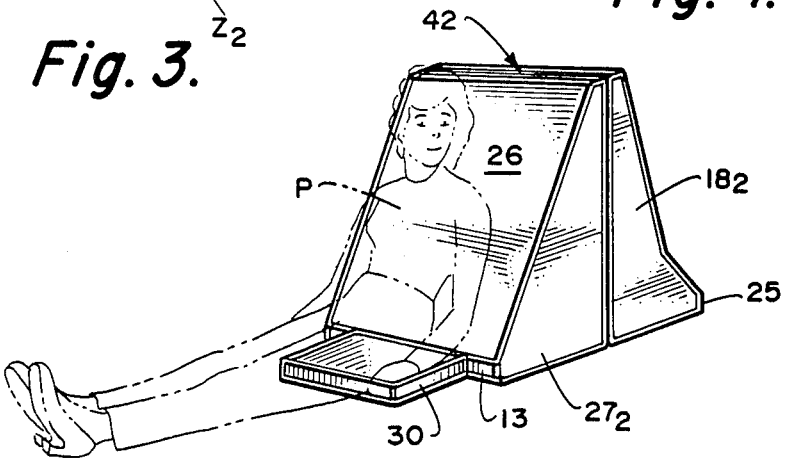
FIG. 5 is a perspective view of the cushions shown in FIG. 3 after they are moved together with a patient being supported thereby and sitting upon a fourth cushion.

As best seen in FIG. 3, when each of the cushions are in their uppermost position, they may be moved together, as shown by Arrows A, to form an abutment joint between first surface (14) and corresponding fourth surface (23). As so juxtaposed, they form an overall assembly having a second overall configuration which is shown in FIG. 5. Since the length along the longitudinal axis $x_1$ and $x_2$ of each cushion is equal, the first and second junctures will be coextensive and form a combined planar area. Additionally, the lateral axis $z_1$, $z_2$ become substantially common to both of the cushions.

FIG. 5 further shows a patient (P) in phantom lines resting with her back against sloping portion (26) while seated upon a fourth cushion (30). In this posture, one or more of the patient's upper lung lobes may be effectively worked upon. Of course, a patient could rest their back against inclined portion (15) or sloping portion (17) or sit upon the inclined portion with their legs staddling the cushions and their chest against the sloping portion (not shown).

The fourth cushion is shown as being a rectangular parallelpiped in shape, but other configurations would work equally as well. When the first and second major cushions are in the second configuration, the fourth cushion is most commonly placed adjacent end areas (13) or (25) as a seat cushion. Of course, it could also be used for head, neck, torso or leg support depending on specific patient needs.

Figure 4:
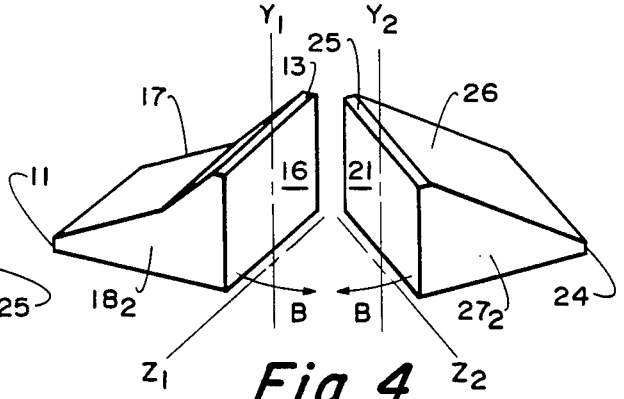
FIG. 4 is an underside perspective view of the first and second cushions in their lowermost position being moved together into a first configuration.
Figure 6:
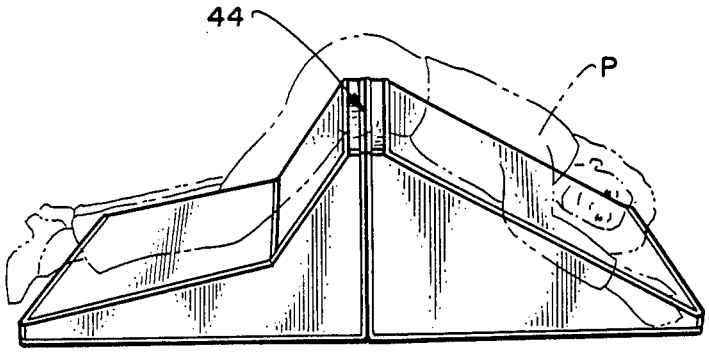
FIG. 6 is a perspective view of the cushions shown in FIG. 4 after they have been moved together into a first configuration with a patient being supported thereby in a prone position.
Figure 7:
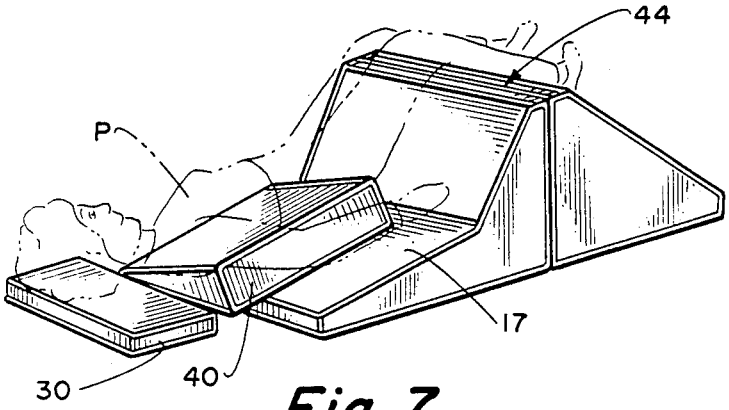
FIG. 7 is a perspective view of the cushions in their first configuration with a patient being supported thereby in a supine position having a fourth cushion head support while also being tilted with a third wedge cushion.
Figure 8:
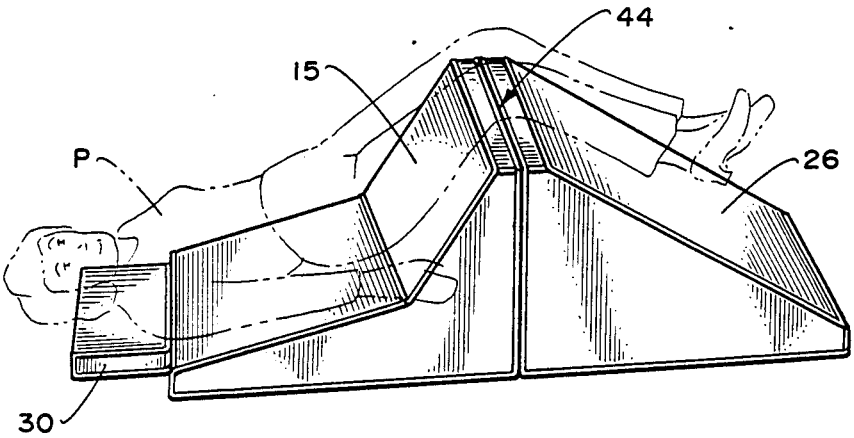
FIG. 8 is a perspective view similar to FIG. 7 except the wedge cushion has been removed from beneath the patient's back.

With reference now to FIG. 4, when the first and second cushions are moved together as shown by Arrows B, an assembly having a first configuration is formed. FIGS. 5-8 show the first configuration in use with patient (P) shown in various orientations for effective respiratory therapy. As so assembled, an abutment joint is formed between the second and third surfaces. Also, it can be seen that the normal axis $y_1$, $y_2$ become substantially common to both cushions as well as the aforementioned $z_1$ and $z_2$ axis. Further, since the distance along axis $y_1$ and $y_2$ of each cushion is equal, the first and second end areas become coextensive and form an overall planar body-supporting region (44). In FIG. 6, said region supports the hip portion of a patient. In FIGS. 7 and 8, it supports the knee areas while in a relaxed elevated position. This is helpful in obtaining the desired patient orientation while also maintaining comfort and relaxation for optimum bronchial therapy.

With reference to FIG. 7, a third wedge-shaped cushion (40) is shown as being utilized to tilt a patient at a predetermined angle for achieving the desired alignment of the patient's airway passages. The third cushion is shown as being located upon the sloping portion (17) of the first cushion, but may also be placed upon the inclined surface (15) of the second sloping portion (26) of the second cushion. It is sized to fit within the various surface areas and, in some cases, it may be desirable to utilize attachment means for releasably securing it to said areas. Means known in the art may be utilized for such purposes such as hoop and hook cloth fastening devices (Velcro), snaps, clips, tape and the like.

It is expected that each of the cushions will be made out of a resilient material such as foam rubber or polyurethane commonly used in furniture cushions. Preferably, the cushions are covered with cleanable cloth or flexible plastic material. Alternatively, any of the cushions may be constructed of an outer shell supported by an inflatable bladder. Inflation may be accomplished with respiratory equipment that is already at hand or readily available to most therapists. Use of inflatable cushions would greatly facilitate storage and handling.

Although not shown, for convenience of handling, it's possible that the abutment corners can be hinged together and that straps or the like may be attached to the apex region (42) for ease in lifting and carrying the cushions in combination. Having a common lateral axis in both configurations permits the formation of a hinge.

When oriented as shown in FIG. 5, the upper lobes of a patient's lung may be worked upon for removal of the desired accumulation of secretions. FIG. 6 depicts a patient orientation for manuevering the lower lung lobes. In FIGS. 7 and 8, the depicted patient orientations are utilized to clear the airways of the middle lobe and lingular segments.

Because of the predetermined surface angles of each cushsion which combine to form the first and second configurations, all the various airways of the patient's lungs may be cleared through therapeutic manipulation of unwanted secretions. As such, an uncomplicated system is provided which is readily utilized by therapists without unwieldly burdensome apparatus. The cushions are inexpensive to construct and are thereby accessible to more needy patients. As such, proper respiratory therapy can be performed not only in conventional medical offices and hospitals, but at out-patient areas such as in a patient's home.

While the invention has been described with respect to preferred embodiments, it will be appreciated that various modifications and improvements can be made without departing from the scope and spirit of the invention. Accordingly, it is to be understood that the invention is not to be limited by the aforesaid embodiments, but only by the scope of the appended claims.

I claim:

1. In combination, therapy cushions arrangable in abutting relationship to support and orient a person for effective bronchial drainage comprising:

a first cushion having a first surface extending about 90° from a second surface that extends between a first abutment corner and a first end area and including an inclined surface extending from said first end area and merging at an obtuse angle with a first sloping portion that terminates at a first juncture with said first surface;

a second cushion having a third surface extending about 90° from a fourth surface between a second abutment corner and a second end area including a second sloping portion extending from said second end area to a second juncture with said fourth surface wherein the distance along corresponding normal axes of said second and third surfaces are equal, said first and second cushions arranged with the first and second abutment corners adjacent each other to form a first configuration when the second and third surfaces are placed against each other and a second configuration when the first and fourth surfaces are placed against each other.

2. The cushions of claim 1 wherein said first and fourth surfaces have equal length along corresponding longitudinal axes.

3. The cushions of claim 1 wherein said first end area is flat and extends about 90° from said second surface and said second end area is flat and extends about 90° from said third surface.

4. The cushions of claim 2 wherein said first juncture is flat and extends about 90° from said first surface and said second juncture is flat and extends about 90° from said fourth surface.

5. The cushions of claim 3 wherein said first, second, third and fourth surfaces are planar and shaped as parallelograms.

6. The cushions of claim 5 wherein the distance along the lateral axes of said first cushion and said second cushion are equal.

7. The cushions of claim 1 including a third cushion that is wedge-shaped and sized to fit within the circumference of either said first or second sloping portion.

8. The cushions of claim 1 including a fourth support cushion for placement adjacent said first or second juncture when the first and second cushions are arranged in said first configuration and adjacent said first or second end area when the first and second cushions are arranged in said second configuration.

* * * * *